US009071016B2

(12) United States Patent
Morello et al.

(10) Patent No.: US 9,071,016 B2
(45) Date of Patent: Jun. 30, 2015

(54) ELECTRICAL CONNECTOR WITH A SLIDING FLEXIBLE CANTILEVER BEAM TERMINAL RETAINER

(71) Applicant: DELPHI TECHNOLOGIES, INC., Troy, MI (US)

(72) Inventors: John R. Morello, Warren, OH (US); James M. Rainey, Warren, OH (US)

(73) Assignee: Delphi Technologies, Inc., Troy, MI (US)

( * ) Notice: Subject to any disclaimer, the term of this patent is extended or adjusted under 35 U.S.C. 154(b) by 145 days.

(21) Appl. No.: 14/045,549

(22) Filed: Oct. 3, 2013

(65) Prior Publication Data

US 2015/0099386 A1 Apr. 9, 2015

(51) Int. Cl.
*H01R 13/40* (2006.01)
*H01R 13/627* (2006.01)

(52) U.S. Cl.
CPC ..... *H01R 13/6272* (2013.01)

(58) Field of Classification Search
USPC ..... 439/595, 744
IPC ..... H01R 13/4223,13/4365, 13/4364, 13/426, H01R 13/434
See application file for complete search history.

(56) References Cited

U.S. PATENT DOCUMENTS

| | | | | |
|---|---|---|---|---|
| 5,980,318 | A | 11/1999 | Morello et al. | |
| 6,390,849 | B1 | 5/2002 | Yamanashi | |
| 6,769,934 | B2 | 8/2004 | Nakamura et al. | |
| 7,048,584 | B1 | 5/2006 | Morello | |
| 7,059,903 | B2 | 6/2006 | Sasaki et al. | |
| 7,179,136 | B1 | 2/2007 | Morello | |
| 7,347,743 | B2 | 3/2008 | Daugherty et al. | |
| 7,384,309 | B1 | 6/2008 | Morello et al. | |
| 7,396,255 | B2 | 7/2008 | Morello et al. | |
| 7,438,585 | B2 * | 10/2008 | Morello | 439/352 |
| 7,658,645 | B1 | 2/2010 | Morello et al. | |
| 8,376,778 | B2 * | 2/2013 | Obata et al. | 439/595 |
| 8,678,866 | B2 * | 3/2014 | Hiraishi | 439/752 |
| 8,795,000 | B2 * | 8/2014 | Sugimoto | 439/595 |

FOREIGN PATENT DOCUMENTS

| | | | |
|---|---|---|---|
| EP | 1863135 | A2 | 12/2007 |
| EP | 1863135 | A3 | 1/2008 |
| EP | 1863135 | B1 | 7/2010 |
| WO | 2012095934 | A1 | 7/2012 |

* cited by examiner

*Primary Examiner* — Hien Vu
(74) *Attorney, Agent, or Firm* — Robert J. Myers

(57) ABSTRACT

An electrical connector configured to retain an electrical terminal including a terminal lock nib that projects inward into a terminal cavity from a first cavity wall for retaining the electrical terminal in the connector body and a flexible cantilever beam that projects axially into the terminal cavity from a fixed end of the cantilever beam. The cantilever beam is located opposite the terminal lock nib and is configured to push the terminal against a second cavity wall and into retaining engagement with the terminal lock nib. The connector also includes a support ridge that projects into the terminal cavity and is configured to contact and restrict movement of a free end of the cantilever beam during insertion of the terminal into the terminal cavity. The terminal has a laterally spaced lock surface engageable with the lock nib and is configured to prevent withdrawal of the terminal from the cavity.

10 Claims, 4 Drawing Sheets

ELECTRICAL CONNECTOR WITH A SLIDING FLEXIBLE CANTILEVER BEAM TERMINAL RETAINER

TECHNICAL FIELD OF THE INVENTION

The invention generally relates to electrical connectors, and more particularly to electrical connectors having terminals retained in cavities of a connector body by a sliding flexible cantilever beam.

BACKGROUND OF THE INVENTION

Connector bodies for electrical connectors used in automotive wiring harnesses have included terminal lock nibs and flexible beams that are fixed at both ends to secure electrical terminals into the terminal cavities of the connector bodies. An example of such an electrical connector may be found in U.S. Pat. No. 7,396,255 issued to Morello, et al. on Jul. 8, 2008. However, as the features of these connector bodies are scaled down to accommodate smaller terminals, e.g. terminals less than 1.5 millimeters (mm) several problems are observed. The lock nibs of connector bodies manufactured of unreinforced thermoplastics may be sheared off by forces exerted by the terminal that are less than the terminal retention force required by automotive standards set by automotive manufacturers or organization such as the United States Council for Automotive Research (USCAR). The lock nibs of connector bodies manufactured from glass fiber reinforced thermoplastics may have sufficient shear strength to meet terminal retention requirements; however the flexible fixed beams of these connector bodies are too stiff to provide an acceptable insertion force for inserting the terminal into the terminal cavity. The present invention provides alternatives to and advantages over the prior art.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF THE INVENTION

In accordance with one embodiment of this invention, an electrical connector body configured to retain an electrical terminal is provided. The electrical connector body includes a terminal cavity that extends through the connector body from a first opening at an insertion end to a second opening at a mating end of the connector body and having a pair of side walls opposite one another and defining a vertical axis and a longitudinal axis. The electrical connector body also includes a rigid terminal lock nib that projects inward into the terminal cavity from a rigid wall for retaining the electrical terminal in the connector body. The electrical connector body further includes a flexible cantilever beam that projects axially into the terminal cavity from a fixed end of the cantilever beam, said cantilever beam located opposite the rigid terminal lock nib and configured to push the electrical terminal against the rigid wall and into retaining engagement with the terminal lock nib. The electrical connector body additionally includes a rigid support ridge that projects into the terminal cavity and is configured to contact and restrict movement of a free end of the cantilever beam during insertion of the electrical terminal into the terminal cavity.

In another embodiment of the present invention, an electrical connector is provided. The electrical connector includes a connector body as described above and an electrical terminal having laterally spaced lock surface transversely faced and engageable with the terminal lock nib configured to prevent withdrawal of the electrical terminal from the terminal cavity of the connector body.

Further features and advantages of the invention will appear more clearly on a reading of the following detailed description of the preferred embodiment of the invention, which is given by way of non-limiting example only and with reference to the accompanying drawings.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

Described herein is a one piece connector body that is capable of retaining electrical terminals smaller than 1.5 mm, such as Performance Pack 1.2 mm series or Performance Pack 0.64 mm series terminals manufactured by Delphi Corporation of Troy, Michigan, without the need for a secondary lock mechanism or a separate terminal position assurance device. The connector body includes a cantilever beam utilized as a spring that holds the terminal against a lock nib. The cantilever beam is supported by a support ridge on the free end; limiting the deflection of the free end of the beam. When a terminal is inserted into the terminal cavity, the cantilever beam is pushed down until it contacts this support ridge. After the beam contacts the ridge, the free end of the beam slides and rotates while the middle portion of the beam continues to deflect. The cantilever beam allows the connector body to be molded from a stiffer material, such as a glass filled thermoplastic to provide a strong lock nib and provide a good hold down force, or normal force, on the terminal.

Figure 1:
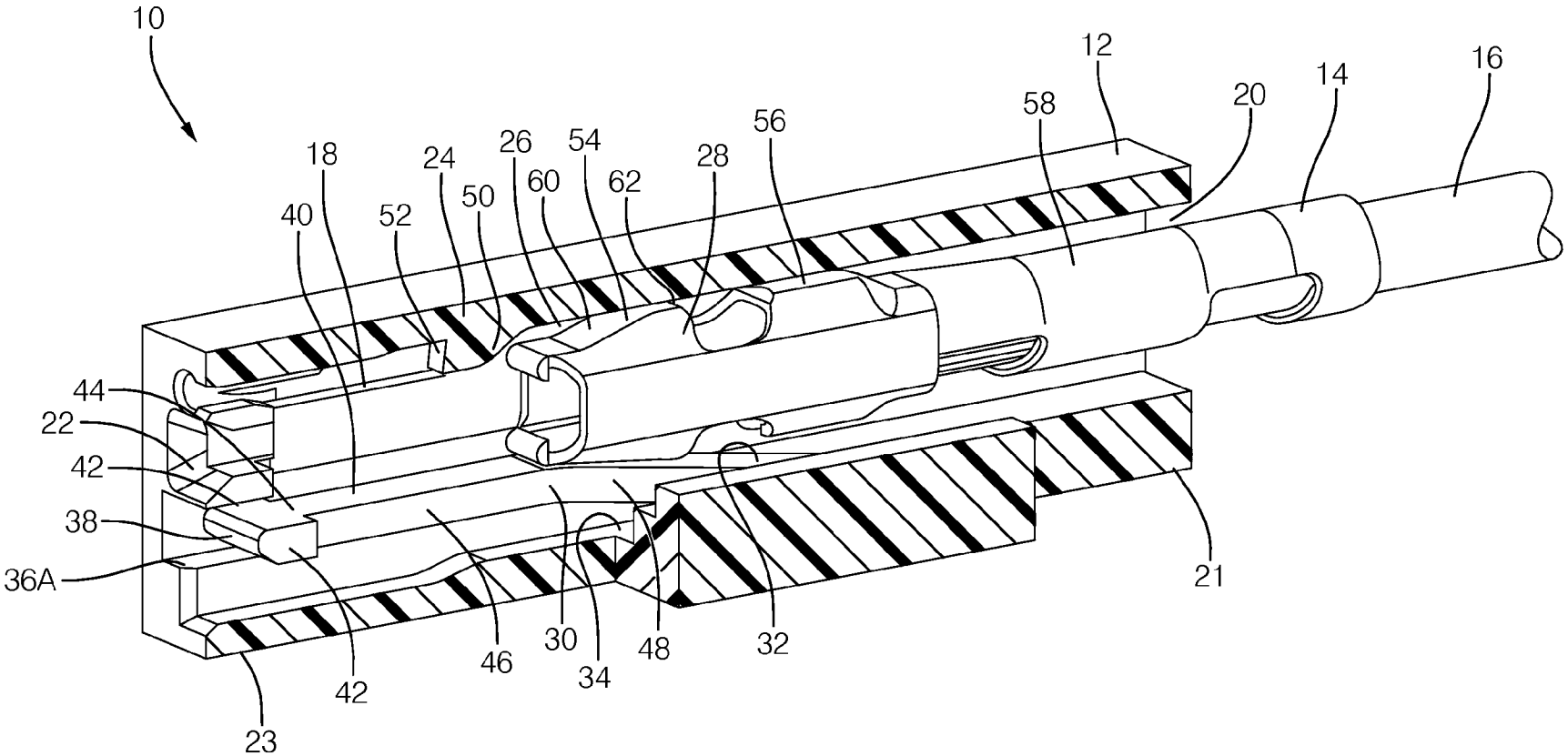
FIG. 1 is a partial perspective cut away view of a connector body of an electrical connector with a partially inserted terminal in accordance with one embodiment.

FIG. 1 illustrates a non-limiting example of an electrical connector 10 including a connector body 12 and an electrical terminal 14, hereinafter referred to as a terminal 14, which is configured to be attached to a wire cable 16. The connector body 12 has a terminal cavity 18 that extends through the connector body 12 from an insertion opening 20 at an insertion end 21 to a mating opening 22 at a mating end 23 of the connector body 12. The connector body 12 has a rigid terminal lock nib 24, hereafter referred to as a lock nib 24, which projects inward into the terminal cavity 18 from an upper rigid wall 26 to retain the terminal 14 in the connector body 12. The terminal 14 has a laterally spaced lock surface 28 that is transversely faced and engages with the lock nib 24 to prevent undesired withdrawal of the terminal 14 from the terminal cavity 18 of the connector body 12. The connector body 12 also has a flexible cantilever beam 30, hereafter referred to as a beam 30, which projects axially into the terminal cavity 18 from a fixed end 32 of the beam 30. The fixed end 32 of the beam 30 is attached to a lower rigid wall 34 of the terminal cavity 18 located opposite the upper rigid wall 26. The beam 30 is located opposite the lock nib 24 and is configured to push the terminal 14 against the upper rigid wall 26 and into retaining engagement with the lock nib 24. The connector body 12 also defines a rigid support ridge 36 that projects into the terminal cavity 18 and is configured to contact and restrict movement of a free end 38 of the beam 30 during insertion of the terminal 14 into the terminal cavity 18. The support ridge 36 is configured to restrict movement of the free end 38 the beam 30 in the vertical axis Y and not in the longitudinal axis Z of the terminal cavity 18.

According to the embodiment illustrated in FIG. 1, the connector body 12 includes a pair of support ridges 36A projecting into the terminal cavity 18 from sidewalls 40 of the terminal cavity 18. The beam 30 defines a pair of lateral protrusions 42 that are configured to contact the pair of support ridges 36A when the beam 30 is pushed down by the terminal 14 when it is inserted into the terminal cavity 18. The pair of support ridges 36A is configured to restrict movement of the free end 38 of the beam 30 in the vertical axis Y and not in the longitudinal axis Z. The pair of lateral protrusions 42 is configured to slide along the pair of support ridges 36A when the terminal 14 is inserted into the terminal cavity 18. A portion of the beam 30 may be configured to pass between the pair of support ridges 36A when the terminal 14 is inserted into the terminal cavity 18. The pair of lateral protrusions 42 and the beam 30 defines a "T shape" 44 at the free end 38 of the beam 30. A first portion 46 of the beam 30, including the fixed end 32, projects axially into the terminal cavity 18 and a second portion 48 of the beam 30 including the free end 38 is generally parallel to the upper rigid wall 26. As used herein, generally parallel means±30° of absolutely parallel.

Figure 2:
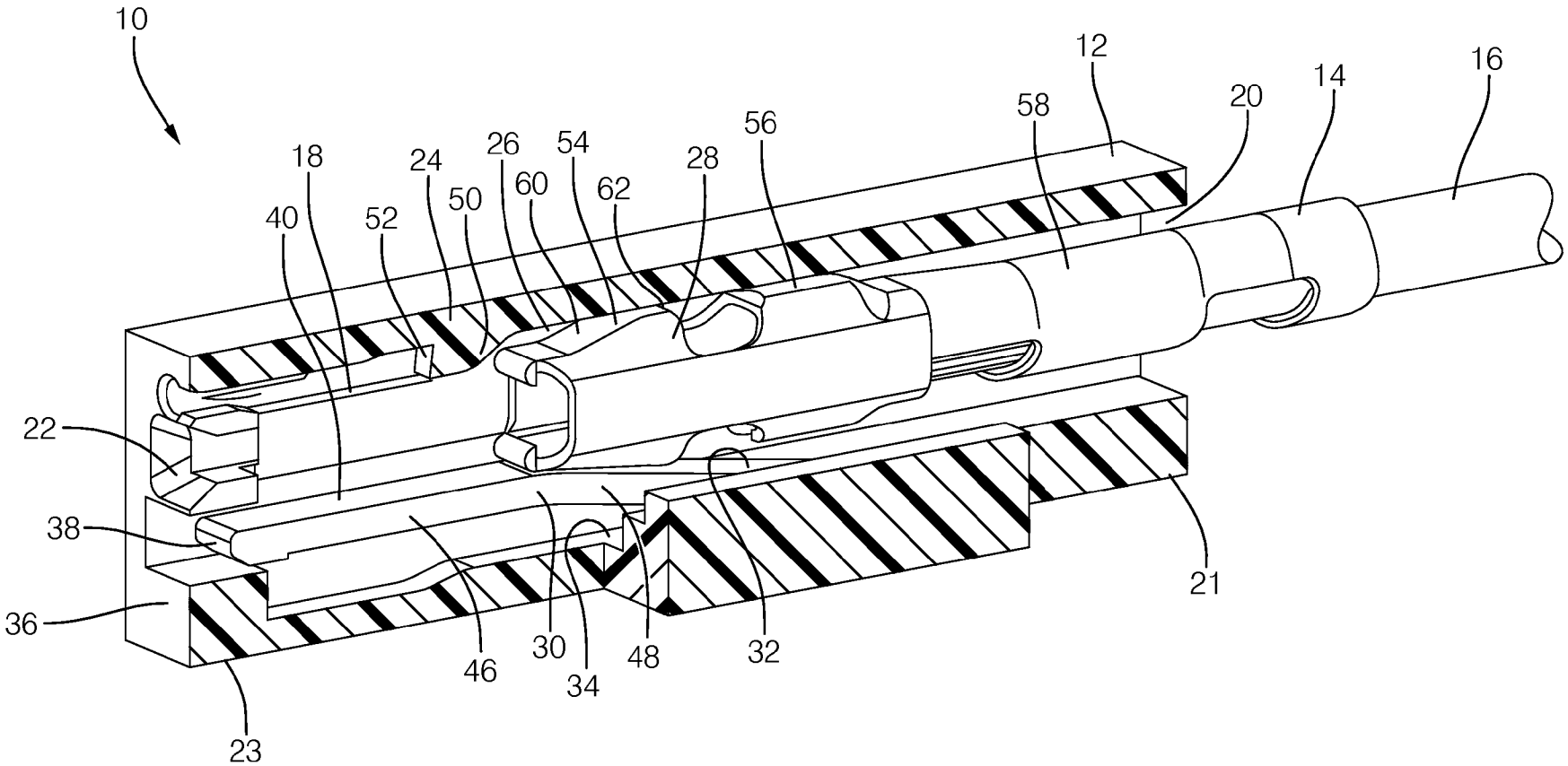
FIG. 2 is a partial perspective cut away view of a connector body of an electrical connector with a partially inserted terminal in accordance with another embodiment.

According to an alternative embodiment illustrated in FIG. 2, the connector body 12 includes a support ridge 36 projecting into the terminal cavity 18 from the mating end 23 of the terminal cavity 18. The support ledge 36 doesn't necessarily have to project from the mating end. The fixed end 32 of beam 30 could be at the mating end 23 with the support ledge 36 at the free end 38 of the cantilever beam 30. The support ledge 36 just has to contact and limit the deflection of the free end 38 of the beam 30. The free end 38 of the beam 30 is configured to contact the support ridge 36 when the beam 30 is pushed down by the terminal 14 when it is inserted into the terminal cavity 18. The support ridge 36 is configured to restrict movement of the free end 38 of the beam 30 in the vertical axis Y and not in the longitudinal axis Z. The free end 38 is configured to slide along the support ridge 36 when the terminal 14 is inserted into the terminal cavity 18.

The lock nib 24 defines a ramp 50 that that slopes inwardly and forwardly toward the mating end 23 of the connector body 12. The ramp 50 leads to a lock shoulder 52. The lock shoulder 52 is preferably but not necessarily set at a slight back angle. The connector body 12 is formed of a dielectric thermoplastic material such as polyamide (PA, NYLON), polybutylene terephthalate (PBT), polypropylene (PP) and is preferably a composite material containing 20 to 40% glass fibers (glass filled plastic). Use of a glass filled plastic for forming the connector body 12 provides the benefit of having a small lock nib 24 that has sufficient shear strength to meet terminal retention force requirements.

Focusing now on the terminal 14, it generally comprises a forward contact portion 54, an intermediate body portion 56, and a rearward attachment portion 58 for attaching the terminal 14 to the wire cable 16. The contact portion 54 of terminal 14 has laterally spaced lock surfaces 28. The contact portion 54 also preferably has terminal ramps 60 that slant outwardly and rearwardly and lead to the respective lock surfaces 28. The contact portion 54 also preferably includes flats 62 located between the terminal ramps 60 and the respective lock surfaces 28.

Figure 3:
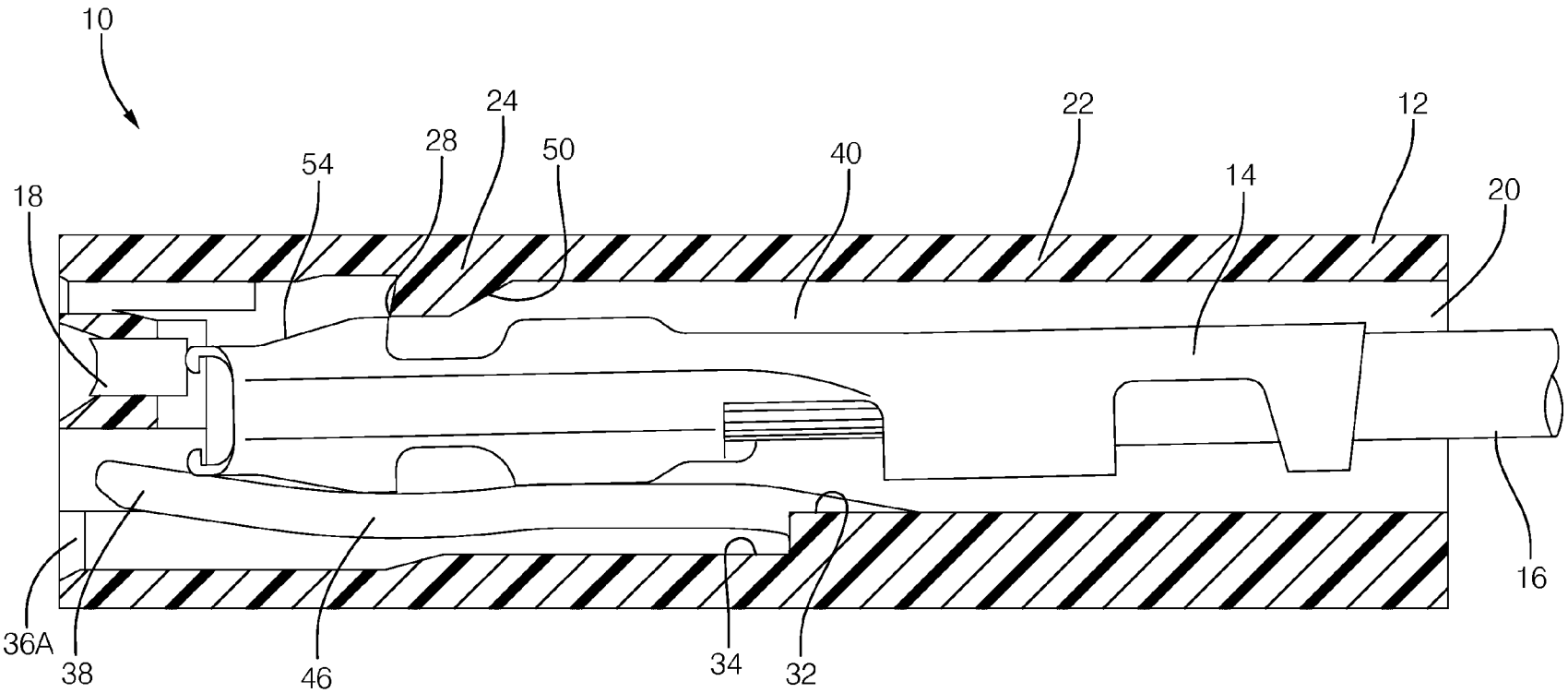
FIG. 3 is a partial cut away side view of the connector body of FIG. 1 with the terminal partially inserted into the terminal cavity in accordance with one embodiment.

As illustrated in FIG. 3, the terminal 14 is inserted into the terminal cavity 18 through the insertion opening 20 of the connector body 12. Without subscribing to any particular theory of operation, when the contact portion 54 of the terminal 14 engages the ramp 50, the beam 30 is depressed by the terminal 14 until the free end 38 of the beam 30 contacts the support ridges 36A. After the beam 30 contacts these support ridges 36A, the first portion 46 of the beam 30 is further deflected while the free end 38 of the beam 30 slides in a direction generally along the longitudinal axis (Z) and rotates about the lateral axis (X) as the contact portion 54 of the terminal 14 rides along ramp 50.

Figure 4:
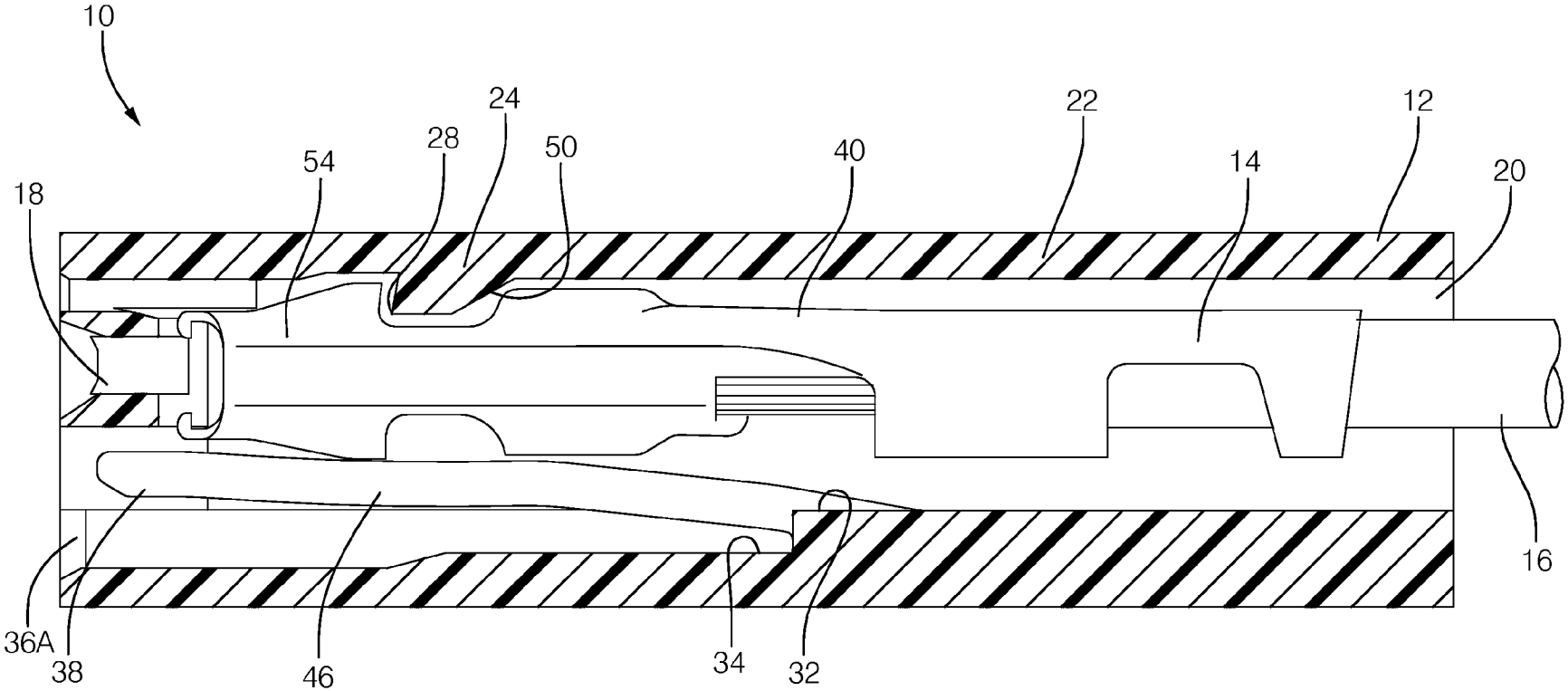
FIG. 4 is a partial cut away side view of the connector body of FIG. 1 with the terminal fully inserted in accordance with one embodiment.

As illustrated in FIG. 4, when the lock surface 28 reaches the lock shoulder 52, the beam 30 springs up so that the beam 30 pushes the terminal 14 against the upper rigid wall 26 and the lock nib 24 engages behind the lock surface 28. The free end 38 of the beam 30 slides back along the longitudinal axis (Z) and rotates back about the lateral axis (X).

The terminal 14 is preferably but not necessarily symmetrical about a horizontal plane so that the terminals are insertable into the terminal cavity 18 either right side up as best shown in FIG. 1 or upside down.

While electrical connector 10 is illustrated as having a single terminal cavity 18, the electrical connector 10 may have any number of terminal cavities 18. Also, while the electrical connector 10 is illustrated having a female socket terminal 14, alternative embodiments may be envisioned for connectors including male terminals having plugs, pins, blades, etc.

Accordingly, an electrical connector 10 and a connector body 12, is provided. The connector body 12 includes a cantilever beam 30 that holds a terminal 14 in place against a lock nib 24 to retain the terminal 14 within a terminal cavity 18 of the connector body 12. The beam 30 allows the connector body 12 to be molded from a glass filled plastic in order to provide a strong lock nib 24 while providing a beam 30 with adequate flexibility. This is especially beneficial for connector bodies designed for smaller terminals.

While this invention has been described in terms of the preferred embodiments thereof, it is not intended to be so limited, but rather only to the extent set forth in the claims that follow. Moreover, the use of the terms first, second, upper, lower, etc. does not denote any order of importance or required orientation, but rather the terms first, second, upper, lower, etc. are used to distinguish one element from another. Furthermore, the use of the terms a, an, etc. do not denote a limitation of quantity, but rather denote the presence of at least one of the referenced items.

We claim:

1. An electrical connector body configured to retain an electrical terminal, comprising:

a terminal cavity, that extends through the connector body from a first opening at an insertion end to a second opening at a mating end of the connector body and having a pair of sidewalls opposite one another and defining a vertical axis and a longitudinal axis;

a rigid terminal lock nib that projects inward into the terminal cavity, from a first rigid wall to engage into one of the pair of sidewalls for retaining the electrical terminal in the connector body;

a flexible cantilever beam that projects axially into the terminal cavity from a fixed end of the cantilever beam connecting to a second rigid wall, said cantilever beam located opposite the rigid terminal lock nib and configured to push the electrical terminal against the second rigid wall and into retaining engagement with the terminal lock nib; and a pair of support ridges projecting into the terminal cavity from sidewalls of the terminal cavity, wherein the cantilever beam defines a pair of lateral protrusions configured to contact the pair of support ridges and wherein the pair of support ridges are configured to restrict movement of the free end of the cantilever beam in the vertical axis and not in the longitudinal axis.

2. The electrical connector body in accordance with claim 1, wherein the pair of lateral protrusions is configured to slide along the pair of support ridges when the electrical terminal is inserted into the terminal cavity.

3. The electrical connector body in accordance with claim 1, wherein a portion of the cantilever beam is configured to pass between the pair of support ridges when the electrical terminal is inserted into the terminal cavity.

4. The electrical connector body in accordance with claim 1, wherein the pair of lateral protrusions and the cantilever beam define a T shape at the free end of the cantilever beam.

5. The electrical connector body in accordance with claim 1, wherein a first portion of the cantilever beam including the fixed end projects axially into the terminal cavity and a second portion of the cantilever beam including the free end is generally parallel to the second rigid wall.

6. The electrical connector body in accordance with claim 1, wherein the connector body is formed of a thermoplastic containing glass fibers.

7. The electrical connector body in accordance with claim 1, wherein the terminal lock nib includes a ramp that slopes inwardly and forwardly toward the mating end of the connector body and leads to a lock shoulder, the lock shoulder being set at a slight back angle.

8. An electrical connector, comprising:

a connector body according to claim 1; and an electrical terminal having a laterally spaced lock surface transversely faced and engageable with the terminal lock nib configured to prevent withdrawal of the electrical terminal from the terminal cavity of the connector body.

9. The electrical connector in accordance with claim 8, wherein the electrical terminal is configured to be attached to a wire cable.

10. The electrical connector in accordance with claim 9, wherein the electrical terminal is symmetrical about a horizontal plane so that the electrical terminal is insertable into the terminal cavity right side up or upside down.

* * * * *